US005915449A

United States Patent [19]

Schwartz

[11] Patent Number: 5,915,449

[45] Date of Patent: Jun. 29, 1999

[54] BOMB BLAST DRAPERY

[76] Inventor: Craig Schwartz, 5117 Dudley La., #303, Bethesda, Md. 20814

[21] Appl. No.: 09/080,304

[22] Filed: May 18, 1998

[51] Int. Cl.[6] ..... A47H 1/00

[52] U.S. Cl. ..... 160/330; 160/349.1

[58] Field of Search ..... 160/330, 348, 160/349.1, 349.2, DIG. 7, 123, 124, 125, 126, 128, 237, 90; 52/222, 202, 63

[56] References Cited

U.S. PATENT DOCUMENTS

| | | | |
|---|---|---|---|
| 2,522,509 | 9/1950 | Fridolph | 160/349.1 X |
| 2,599,429 | 6/1952 | Bernhard | 160/348 |
| 3,224,495 | 12/1965 | Truesdale | 160/349.1 |
| 4,180,352 | 12/1979 | Divers et al. | 160/330 X |
| 4,874,028 | 10/1989 | Lynch et al. | 160/349.1 X |

*Primary Examiner*—David M. Purol

*Attorney, Agent, or Firm*—Diller, Ramik & Wight, PC

[57] ABSTRACT

A bomb blast drapery is defined by a sheet of substantially resilient fabric having high burst strength and substantial fullness in width and length such as to project peripherally beyond a glass window in a wall opening of an associated building. The fabric sheet has a fullness in a width direction approximately 2½ times the wall opening width and a length fullness ranging from 20" for a window height of approximately 10" up to approximately 380" for a window height of up to 190". The burst strength of the fabric sheet is approximately 110 lbs. and the weight thereof is substantially 4.2 oz. per linear yard. A bottom hem of the flexible sheet includes a weight and the hem further includes a multiplicity of overfolds housed in a trough. The strength of the fabric sheet, its width and vertical fullness and the weighted bottom hem essentially prevent debris, such as glass shards, created by a bomb blast from adversely effecting humans and property adjacent a window with which the bomb blast drapery is associated.

34 Claims, 4 Drawing Sheets

BOMB BLAST DRAPERY

BACKGROUND OF THE INVENTION

In early 1993 U.S. Pat. No. 2,317,452 granted to Alfred M. Goodloe for a black-out shade made from light impervious material which was reinforced against tearing, rupture or the like, particularly by shattered glass or other flying debris, and yet was sufficiently flexible to allow the same to be readily rolled upon itself, thus permitting its attached mounting upon and for manipulation by rollers, such as shade or like rollers, whereby the same could be rolled up out of the way when not in use and yet could be rendered quickly available for convenient manipulation and use when required to be drawn down in covering relation to an associated window. The light impervious sheet material was reinforced with facings of knitted metallic wire mesh, and was of a selected width and length suitable to adequately cover a window, door or other opening desired to be blacked-out thereby due to the light imperviousness of the material. Preferably, the light impervious sheet and the knitted metallic fabric sheet were secured together by over-edge stitching. This composite black-out shade was mounted with the knitted metallic mesh facing outward, that is toward the door or window opening to be covered thereby. The metallic knitted mesh was so positioned to prevent glass or other flying debris from rupturing the light impervious sheet to maintain the "black-out" characteristics of the shade.

U.S. Pat. No. 3,004,769 granted on Oct. 17, 1961 for a trailer skirt which encloses the gap between the bottom peripheral edge of a house trailer and the ground. This patent was developed during a search of the instant invention, but has nothing to do with bomb blast protection. However, this patent discloses the provision of weighted rods housed in lower loops of the trailer skirt to prevent transverse or lateral movement thereof.

U.S. Pat. No. 3,818,970 granted on Jun. 25, 1974 to Rudolf Schmitz et al. discloses a conventional method of producing a weighing band for curtains, drapes and the like.

SUMMARY OF THE INVENTION

The drapery of the present invention was developed in response to the heightened national and global awareness of the need to improve all aspects of security in public areas. This growing awareness is largely due to the increase of terrorist attacks on government buildings, banking institutions and embassies in cities all around the world. The bomb blast drapery of the present invention protects people otherwise vulnerable to explosive charge attacks, particularly from deadly flying glass shards which are contained by the drapery thus greatly reducing danger in potentially hazardous blast situations.

Though security is the most compelling reason for installing bomb blast draperies, decorative features and the highest quality attributes of conventional draperies have not been sacrificed. For example, the bomb blast drapery of the present invention is made of attractive fabric that allows light to enter a room while minimizing visibility from the outside yet meets or exceeds conventional safety requirements, such as conventional fire resistance tests.

The fabric of the blast drapery or blast curtain is constructed of a warp knitted, matt polyester filament, and is produced as a plain warp knitted marquisette of firm non-slip construction. The weight of the fabric is preferably 4.2 oz. per linear yard and the burst strength is approximately 108.9 lbs. average. This fabric is cut at a 90° angle to the selvage on non-railroaded panels and the table cut for non-railroaded panels. A top hem is formed into a double rod pocket header with shirring attached to the back to form a plurality of vertical pleats, while a bottom hem has a double pocket receiving fabric cover lead weights weighing approximately 14.9 oz. per linear yard sewn therein. Side hems are double turned, 1" wide and sewn from top to bottom prior to sewing the top hem rod pocket and the bottom hem weight pocket. A 2.5× fullness in width is the minimum fullness acceptable for optimum bomb blast protection. Length fullness varies between approximately 20" for a glass window or glazing ranging between 0" to 10", and at the high range (170.25"–190") of vertical glass height, the drapery vertical length fullness is approximately 380". Obviously, such drapery length fullness requires an accommodation which is achieved by a multi-folded bottom portion which is housed in an upwardly opening trough supported on or adjacent a sill of a window with which the bomb blast drapery is associated. The width and length fullness of the bomb blast drapery, along with proper drapery mounting, assures that flying glass shards and other debris are safely retained by the drapery under most blast conditions and individuals who might otherwise be injured thereby are fully protected.

Bomb blast draperies constructed in accordance with this invention as aforesaid have been extensively tested with window glass of varying thickness. One test was conducted using ½ lb. of commercial gelatin dynamite detonated at a distance of 12" from the center of untreated glass and the result evidenced the suitability of the invention as a defensive strategy for explosions, both at close range and for blocks surrounding the point of detonation. A high degree of protection was afforded such detonation by virtue of the strength of the fabric of the drapery, particularly its burst strength, and its fullness both in width and vertically, as defined by the vertical pleats and the bottom end multi-folds which in conjunction with the weighted terminal bottom edge achieves shard confinement even under relatively high detonation/blast forces.

On Jan. 26, 1998 another explosive test was conducted to evaluate performance of the blast drapery of the present invention. The test was conducted in accordance with the U.S. General Services Administrations "Standard Test Method for Glazing and Glazing Systems Subject to Airblast Loadings." This draft standard is an adaptation of the ASTM method F1642-96. During the explosive test, ¼" thick annealed glass windows were subject to a 4 psi overpressure from the detonation of 600 lb. of Ammonium Nitrate and Fuel Oil (ANFO) which is the equivalent to the detonation of 500 lb. of TNT. The test windows were nominally 4'×5½', and included windows with and without blast drapery protection.

The result of the test evidenced that windows absent blast draperies failed catastrophically propelling hazardous shards of glass to the back of an enclosed test cubicle at high velocity. This response corresponds to GSA hazard/protection Condition 5 (high hazard and low level of protection). An identical window with the blast drapery of the present invention installed and tested to identical blast conditions reflected a significant reduction in hazard, namely, the glass shards were caught and retained by the blast drapery. This result corresponds to a GSA Condition 3 (low hazard and high level protection). The tested pressure level and resulting Condition 3 indicates that the blast drapery/curtain of the present invention is an appropriate and viable technology for meeting GSA's glazing protection requirements for Level C buildings in the federal inventory.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 3 is vertical cross-sectional view taken generally along line 2—2 of FIG. 1, but illustrates the configuration and function of the bomb blast drapery upon the detonation of a bomb or the like.

DESCRIPTION OF THE PREFERRED EMBODIMENTS

Figure 1:
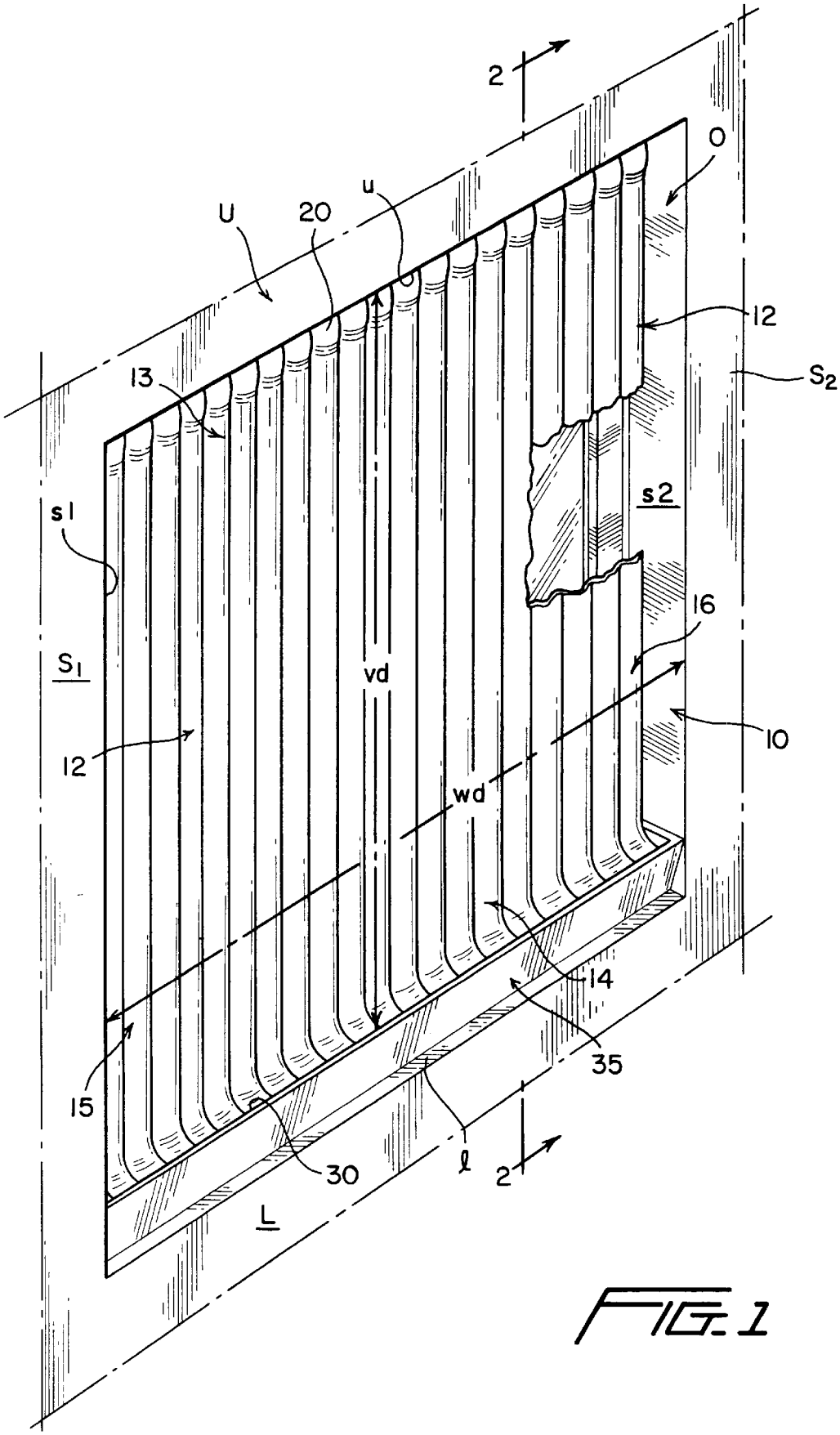
FIG. 1 is a perspective view of a bomb blast drapery of the present invention, and illustrates the same installed relative to a window.
Figure 2:
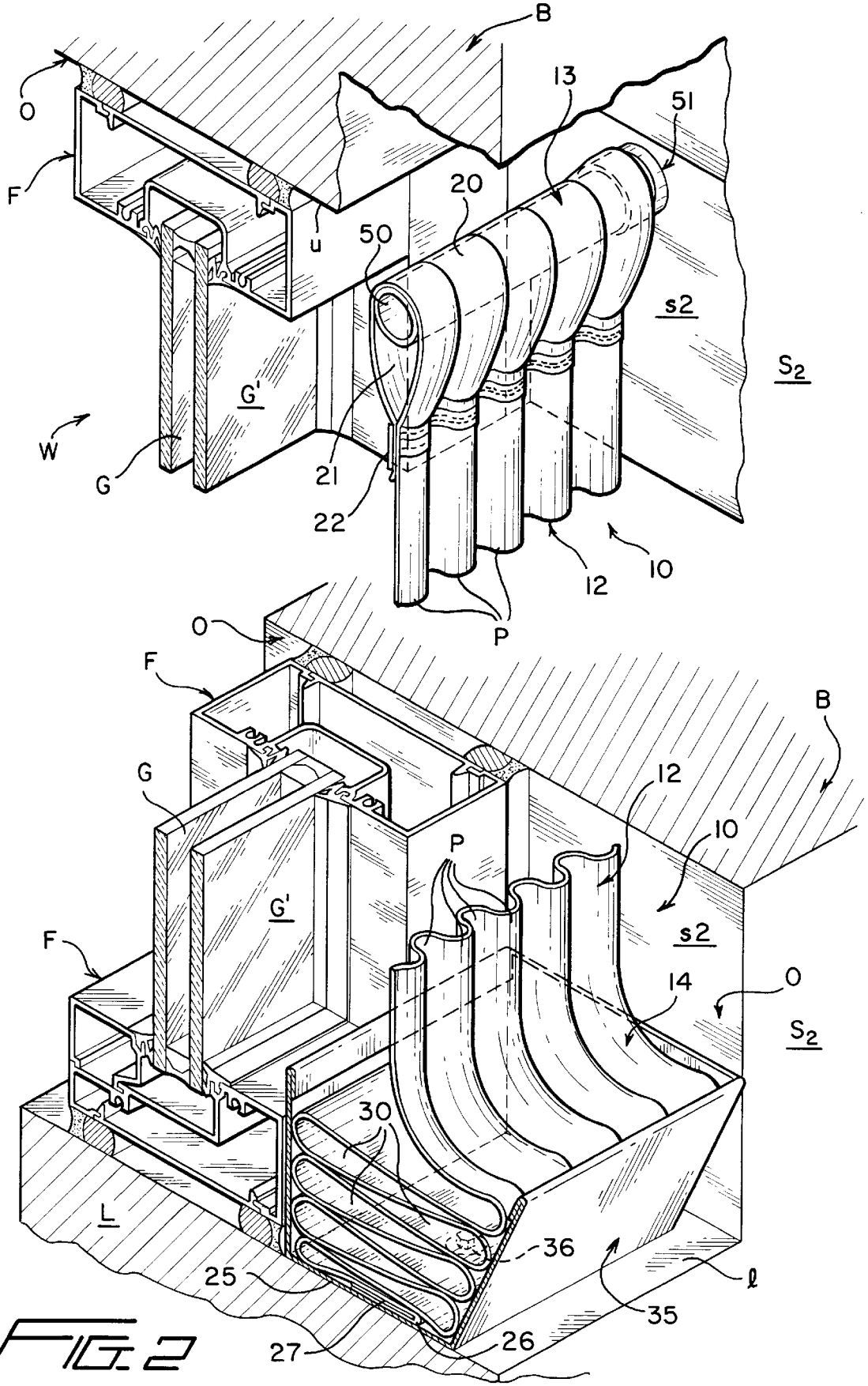
FIG. 2 is a fragmentary enlarged cross-sectional view taken generally along line 2—2 of FIG. 1, and illustrates a suspension rod passing through a double rod pocket of a top hem of the bomb blast drapery, shirring tape associated therewith for forming vertical pleats, and a lower weighted hem portion multi-folded upon itself and housed within a trough.
Figure 3:
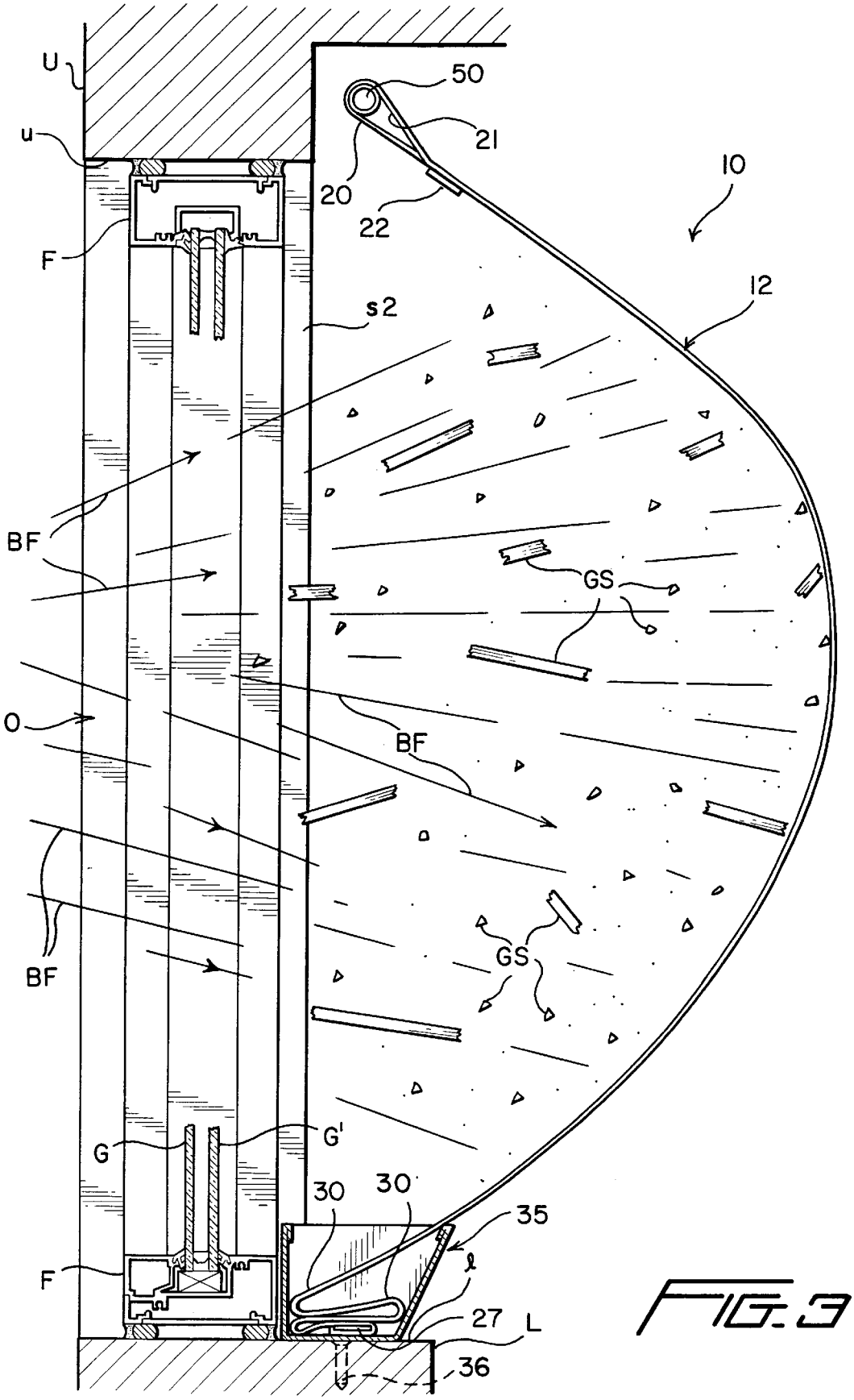

A novel bomb blast drapery or curtain constructed in accordance with this invention is fully illustrated in FIGS. 1, 2 and 3 of the drawings and is generally designated by the reference numeral 10.

The bomb blast drapery 10 is associated with a conventional double-glazed or insulating glass window W (FIGS. 2 and 3) defined by a conventional window frame F conventionally mounted in an opening O of a building B and peripherally bounding spaced sheets, panels, panes or glazing of insulating glass G, G'.

The opening O of the building B is defined by an upper frame portion or head portion U (FIG. 1) a lower frame portion or sill portion L and opposite side frame portions S1, S2. The upper and lower frame portions U, L, respectively, include respective inner upper and lower surfaces u, l (FIG. 1) spaced a predetermined vertical distance vd (FIG. 1) from each other. The side frame portions S1, S2 likewise include respective side surfaces s1, s2 which are spaced a predetermined width distance wd from each other. The distances vd and wd are of importance to the overall construction, installation and operation of the bomb blast drapery 10, as will be apparent more fully hereinafter.

The bomb blast drapery or curtain 10 is constructed from one or more sheets or pieces of fabric, such as SD56238 which is available from Skyline Mills of 4111 Howard Avenue, Kensington, Md. 20895. The fabric sheet is generally designated by the reference numeral 12 and includes an upper portion 13, a lower portion 14, a side portion 15 and an opposite side portion 16 (FIG. 1). Preferably, the fabric or fabric sheet 12 is cut at a 90° angle to the selvage on non-railroaded panels and table cut for non-railroaded panels.

The upper edge or upper edge portion 13 includes a top hem 20 (FIG. 2) formed as a double rod pocket 21 with a strip of shirring tape 22 attached to the back (unnumbered) of the bomb blast drapery 10 facing or opposing the glass panel G' of the window W. The pocket 21 is at a minimum 1¾" and at a maximum 2¼" with the stitched seam (unnumbered) between the fabric sheet 12 and the shearing tape 22 being double chain stitching at a minimum of ⅜" and a maximum of 1" using A7 thread and 10 stitches per inch. The side edges 15, 16 are also preferably hemmed (not shown) by being double turned 1" wide and sewn using a single safety locking stitch set at 8 stitches per inch using A7 thread with strengthening ribbon (not shown) inserted from top to bottom in the side hems prior to sewing the pocket 21.

If center seams or middle seams are required, depending upon the width distance wd (FIG. 1), such seams are surged together, double turned and sewn using a single safety locking stitch set at 8 stitches per inch, again using A7 thread.

The bottom edge or edge portion 14 of the fabric sheet 12 is likewise formed into a bottom hem 25 formed into a double pocket 26 (FIG. 2) into which is inserted a fabric covered lead weight 27 weighing approximately 14.9 oz. per linear yard, which is preferably tacked to the bottom hem 25 in the manner heretofore described with respect to the formation of middle or center seams. The weight 27 is relative flat and extends substantially the entire width distance wd in the pocket 26. The lower end portion 14 of the fabric sheet 12 includes a multiplicity of folds or overfolded folds 30 (FIG. 2) which are retained in an upwardly opening holding means 35 formed as an aluminum or similar metal trough. The trough 35 is secured by a plurality of fasteners 36 to the lower frame portion L with the trough 35 preferably resting upon the lower surface 1 (FIG. 1) of the lower frame portion L.

The shirring tape 22 and the associated stitching define a plurality of vertical folds or pleats P (FIGS. 1 and 2) of the fabric sheet 12. The number of vertical pleats P add to the total overall width or "fullness" of the fabric sheet 12 as measured between the side edge portions 15, 16. The total width or "fullness" of the fabric sheet 12 in the width direction is 2.5 times (2.5×) the distance wd between the surfaces s1, s2. For example, if the window W has a width distance wd of approximately 30", the fullness in the width direction (between the side edge portions 15, 16) of the fabric sheet 12 would at a minimum be 75" minimum (2.5×30").

The bomb blast drapery 10 also preferably includes a vertical length or "fullness" which is defined as the total distance between the top hem 20 and the bottom hem 25 and is reflected in the following Length Fullness Chart:

Length Fullness Chart

| Glazing | Finished Drapery (Min.) |
|---|---|
| 0"–10" | 20" |
| 10.25"–30" | 60" |
| 30.25"–50" | 100" |
| 50.25"–70" | 140" |
| 70.25–90" | 180" |
| 90.25"–110" | 220" |
| 110.25"–130" | 260" |
| 130.25"–150" | 300" |
| 150.25"–170" | 340" |
| 170.25"–190" | 380" |

As one example, if one or more of the glass panels or glazing GG' range in vertical height between 90.25" and 110", the total vertical minimum length of the drapery 10 or the fabric sheet 12, as measured between the upper and lower hems 20, 25, respectively, would be approximately 220".

The length fullness and the width fullness of the bomb blast drapery 10 and/or the fabric sheet 12 is essential to provide drapery expansion and glass shard retention under blast conditions, as is schematically depicted in FIG. 3 and as will be described more fully hereinafter.

The bomb blast drapery 10 is preferably supported by a tubular metallic curtain rod 50 (FIG. 2) extending substantially between the surfaces s1, s2 and being secured thereto by inside mount brackets 51 at axially opposite ends (unnumbered) of the rod 50. The rod 50 has a wall thickness of no less than 0.4" (1 mm) while each inside mount bracket 51 is made of solid brass or brass plated steel of a generally cup-shaped configuration having a wall thickness of not less than 0.18" (4.50 mm) thick. Interior surfaces (unnumbered) of each cup-shaped bracket 51 are coarse threaded to a depth of not less than ¾" (19.5 mm) to threadedly accommodate therein a like 1" (25.4 mm) external thread upon axially opposite ends of the rod 50. Each cup-like bracket 51 is secured in the associated side frame S1, S2 of the building B by two zinc chromate finished hex head screws which are not illustrated with respect to the disclosure of FIGS. 1 through 3, but like hex head screws are illustrated in association with an outside mount bracket 61 in FIGS. 4 and 5 with the screws being generally designated by the reference numeral 62. Each hex head screw 62 (#8×3" long) is mounted into an 8-14-1.5 lead shield 63 set into bores (unnumbered) of the frame portion (S1 or S2 or both) which is illustrated as wood, but can be concrete or the like.

When each inside mount bracket is thus rigidly secured to the side frame portions S1, S2, the bomb blast drapery 10 is rigidly secured in its operative position (FIGS. 2 and 3) and can withstand extreme blast forces, such as a bomb blast force BF depicted in FIG. 3 which generates glass shards GS from the glass panels G,G1. The force BF and the glass shards GS initially impact against the fabric sheet 12 when disposed vertically (FIG. 2), but obviously the force BF of the blast and the glass shards GS "balloon" the fabric sheet 12 inward progressively unpleating the vertical pleats P and unfolding the bottom folds 30 in the manner depicted in FIG. 3. Depending upon the force BF, several or all of the folds 30 will unfold and under extremely high detonation and attendant blast forces BF, the entire bottom hem 25 and the weight 27 might, in fact, be pulled out of the trough 35. However, even under the latter extreme conditions, the glass shards GS will essentially be halted in their flight and injury to humans and/or property is essentially eliminated or reduced to an optimum minimum. Thus, the high bursting strength and the vertical pleating in association with the horizontal bottom weighting and folding assures containment of most if not all materials which might otherwise adversely impact upon humans and property within the building B adjacent the window W.

Figure 5:
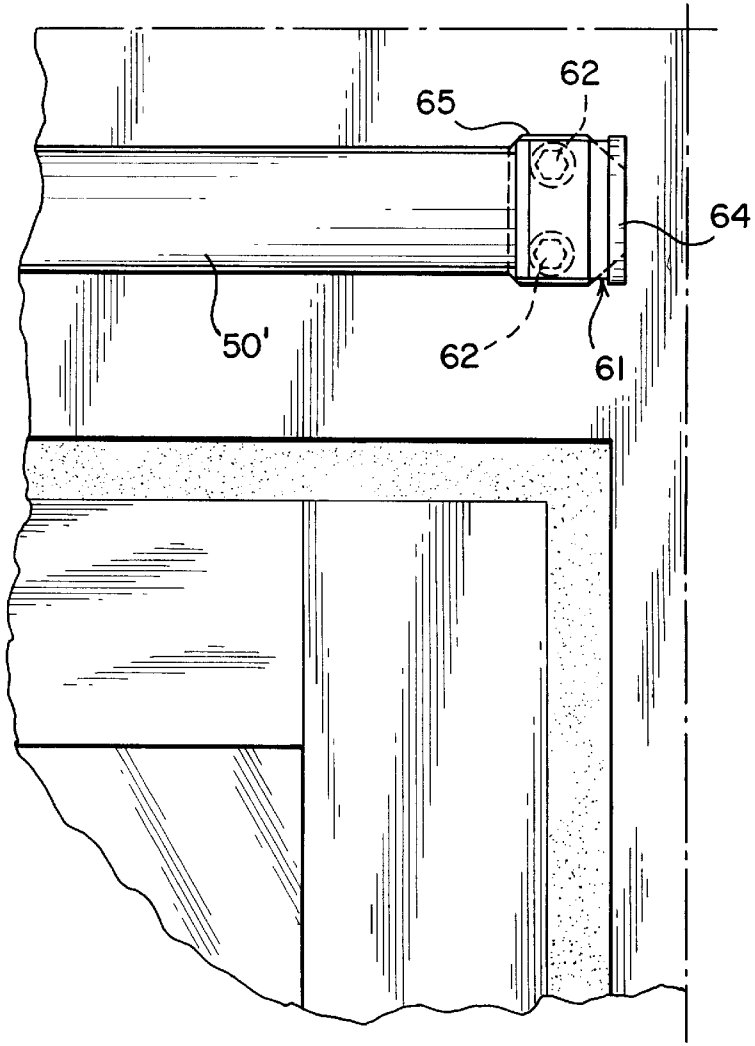
FIG. 5 is a fragmentary front elevational view looking from right-to-left in FIG. 4, and illustrates further details of the outside mount bracket.
Figure 4:
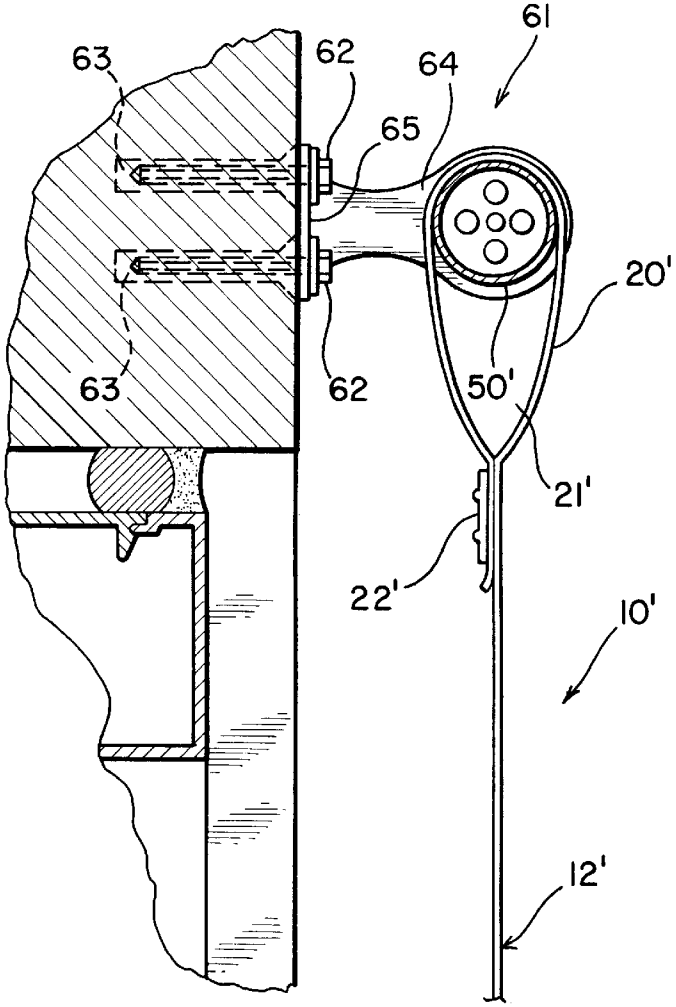
FIG. 4 is an enlarged fragmentary vertical cross-sectional view through the bomb blast drapery of the present invention, and illustrates the manner in which the same is mounted exteriorly of a window by an outside mount bracket.

With respect to FIGS. 4 and 5 of the drawings, a bomb blast drapery or curtain 10' is identical to the bomb blast drapery 10 and like structure is identified with corresponding primed numerals. The major difference between the bomb blast draperies 10, 10' is that the bomb blast drapery 10 is secured to the surfaces s1, s2 by the inside mount brackets 51 whereas the bomb blast drapery 10' is secured by outside mount brackets 61 at axially opposite ends of the curtain rod 50'. Each outside mount bracket 61 includes a like internally threaded cup into which an externally threaded portion of the rod 50' is threaded. However, the cup is an integral part of the outside mounting bracket 61 which includes an arm 64 and a mounting flange 65 normal thereto. The mounting flange 65 includes holes (unnumbered) through which the hex head screws 62 pass prior to being threaded into the lead shields 63. Apart from the outside mounting of the bomb blast drapery 10' and the specifics of the outside mount brackets 61 thereof, the structure and operation of the bomb blast drapery 10' is identical to that heretofore described relative to the bomb blast drapery 10.

Although a preferred embodiment of the invention has been specifically illustrated and described herein, it is to be understood that minor variations may be made in the apparatus without departing from the spirit and scope of the invention, as defined the appended claims.

I claim:

1. Bomb blast drapery comprising a sheet of substantially resilient fabric having relatively high burst strength and substantial fullness in width and length such as to project peripherally beyond a glass window in a wall opening with which the drapery is adapted to be associated, means for securing an upper edge portion of said fabric sheet to a wall with which the glass window is associated, said drapery including a multi-folded lower end portion having a terminal end portion, and weight means at said terminal end portion for imparting motion resistance to said fabric sheet when the latter is subject to the force of a bomb blast during and after unfolding of said multi-folded lower end portion.

2. The bomb blast drapery as defined in claim 1 including means for housing said pleated lower end portion.

3. The bomb blast drapery as defined in claim 1 wherein said fabric sheet upper end portion is folded upon itself to define an elongated pocket, shirring tape secured below said elongated pocket to form a plurality of vertical pleats in said fabric sheet, a suspension rod spanning said elongated pocket, and bracket means for securing axial ends of said suspension rod to a wall housing the window.

4. The bomb blast drapery as defined in claim 1 wherein said weight means is a piece of metal.

5. The bomb blast drapery as defined in claim 1 wherein the burst strength of the fabric sheet is substantially approximately 110 lbs.

6. The bomb blast drapery as defined in claim 1 wherein the burst strength of the fabric sheet is substantially approximately 110 lbs, and the weight of the fabric sheet is substantially 4.2 oz. per linear yard.

7. The bomb blast drapery as defined in claim 1 wherein said weight means weighs substantially 15 oz. per linear yard.

8. The bomb blast drapery as defined in claim 1 wherein the fullness of the fabric sheet in the width direction is approximately 2½ times the wall opening width.

9. The bomb blast drapery as defined in claim 1 wherein the fullness of the fabric sheet in the length direction is approximately 20" for a window height up to 10" and ranges up to approximately 380" for a window height up to 190".

10. The bomb blast drapery as defined in claim 1 wherein said fabric sheet terminal end portion is folded upon itself to form a lower elongated pocket, and said weight means is located in said lower elongated pocket.

11. The bomb blast drapery as defined in claim 1 wherein said fabric sheet terminal end portion is folded upon itself to form a lower elongated pocket, and said weight means is an elongated piece of metal located in said lower elongated pocket.

12. The bomb blast drapery as defined in claim 2 wherein said housing means is a trough.

13. The bomb blast drapery as defined in claim 2 wherein said housing means is an upwardly opening trough.

14. The bomb blast drapery as defined in claim 2 wherein said fabric sheet upper end portion is folded upon itself to define an elongated pocket, shirring tape secured below said elongated pocket to form a plurality of vertical pleats in said fabric sheet, a suspension rod spanning said elongated pocket, and bracket means for securing axial ends of said suspension rod to a wall housing the window.

15. The bomb blast drapery as defined in claim 2 wherein said weight means is a piece of metal.

16. The bomb blast drapery as defined in claim 2 wherein said fabric sheet terminal end portion is folded upon itself to form a lower elongated pocket, and said weight means is located in said lower elongated pocket.

17. The bomb blast drapery as defined in claim 2 wherein said fabric sheet terminal end portion is folded upon itself to form a lower elongated pocket, and said weight means is an elongated piece of metal located in said lower elongated pocket.

18. The bomb blast drapery as defined in claim 3 wherein said fabric sheet terminal end portion is folded upon itself to form a lower elongated pocket, and said weight means is an elongated piece of metal located in said lower elongated pocket.

19. The bomb blast drapery as defined in claim 3 wherein said housing means is an upwardly opening trough.

20. The combination of a window and bomb blast drapery comprising a window including a glass panel supported relative to a building opening defined by upper and lower frame portions and opposite side frame portions defining a predetermined width and vertical length; a bomb blast drapery including a sheet of substantially resilient fabric having relatively high burst strength and substantial fullness in width and length such as to project peripherally beyond said upper, lower and side frame portions; means for securing an upper edge portion of said fabric sheet to said upper frame portion, said drapery including a multi-folded lower end portion having a terminal end portion, and weight means at said terminal end portion for imparting motion resistance to said fabric sheet when the latter is subject to the force of a bomb blast during and after unfolding of said multi-folded end portion.

21. The window and bomb blast drapery combination as defined in claim 20 including trough means for housing said multi-folded lower end portion.

22. The window and bomb blast drapery combination as defined in claim 20 including upwardly opening trough means for housing said multi-folded lower end portion.

23. The window and bomb blast drapery combination as defined in claim 20 wherein said fabric sheet upper end portion is folded upon itself to define an elongated pocket, a suspension rod spanning said elongated pocket, and bracket means for securing axial ends of said suspension rod to said frame portions.

24. The window and bomb blast drapery combination as defined in claim 20 wherein said fabric sheet upper end portion is folded upon itself to define an elongated pocket, a suspension rod spanning said elongated pocket, bracket means for securing axial ends of said suspension rod to said frame portions, a plurality of fasteners for fastening each bracket means to an associated frame portion, and each fastener being threaded in lead sleeve which is in turn embedded in a hole of an associated frame portion.

25. The window and bomb blast drapery combination as defined in claim 20 wherein the burst strength of the fabric sheet is substantially approximately 110 lbs.

26. The window and bomb blast drapery combination as defined in claim 20 wherein the burst strength of the fabric sheet is substantially approximately 110 lbs., and the weight of the fabric sheet is substantially 4.2 oz. per linear yard.

27. The window and bomb blast drapery combination as defined in claim 20 wherein the fullness of the fabric sheet in the width direction is approximately 2½ times the distance between the side frame portions.

28. The window and bomb blast drapery combination as defined in claim 20 wherein the fullness of the fabric sheet in the height direction is approximately 20" for a distance of up to 10" between said upper and lower frame portions and ranges up to approximately 380" for a distance of up to 190" between said upper and lower frame portions.

29. The window and bomb blast drapery combination as defined in claim 22 wherein said fabric sheet upper end portion is folded upon itself to define an elongated pocket, a suspension rod spanning said elongated pocket, and bracket means for securing axial ends of said suspension rod to said frame portions.

30. The window and bomb blast drapery combination as defined in claim 22 wherein the burst strength of the fabric sheet is substantially approximately 110 lbs.

31. The window and bomb blast drapery combination as defined in claim 22 wherein the burst strength of the fabric sheet is substantially approximately 110 lbs., and the weight of the fabric sheet is substantially 4.2 oz. per linear yard.

32. The window and bomb blast drapery combination as defined in claim 22 wherein the fullness of the fabric sheet in the width direction is approximately 2½ times the distance between the side frame portions.

33. The window and bomb blast drapery combination as defined in claim 22 wherein the fullness of the fabric sheet in the height direction is approximately 20" for a distance of up to 10" between said upper and lower frame portions and ranges up to approximately 380" for a distance of up to 190" between said upper and lower frame portions.

34. The window and bomb blast drapery combination as defined in claim 32 wherein the fullness of the fabric sheet in the height direction is approximately 20" for a distance of up to 10" between said upper and lower frame portions and ranges up to approximately 380" for a distance of up to 190" between said upper and lower frame portions.

* * * * *